United States Patent [19]

Feinbloom

[11] 3,959,612

[45] May 25, 1976

[54] ROTARY SWITCH ASSEMBLY PARTICULARLY ADAPTED FOR USE WITH FIBER OPTIC LIGHT SOURCES

[75] Inventor: Richard E. Feinbloom, New York, N.Y.

[73] Assignee: Designs for Vision, Inc., New York, N.Y.

[22] Filed: Sept. 25, 1974

[21] Appl. No.: 509,000

[52] U.S. Cl. ..... 200/11 R; 200/51.03; 240/1.4

[51] Int. Cl.[2] ..... H01H 19/58; H01H 21/78; H01R 19/50; F21V 23/04

[58] Field of Search ..... 200/5 F, 11 R, 11 G, 200/11 J, 11 K, 51.02–51.05; 240/1.3, 1.4, 10.63, 37, 37.1, 65, 66, 122; 315/313, 362

[56] References Cited

UNITED STATES PATENTS

| | | | |
|---|---|---|---|
| 897,455 | 1/1908 | Caldwell | 200/51.03 |
| 1,105,829 | 8/1914 | Plummer et al. | 240/37.1 |
| 1,238,868 | 9/1917 | Wirt | 240/122 |
| 1,736,779 | 11/1929 | Despard et al. | 200/51.03 |
| 2,244,114 | 6/1941 | Noir | 200/51.03 X |
| 2,300,993 | 11/1942 | Taylor | 200/11 J X |
| 2,644,152 | 6/1953 | Ginsberg | 315/313 X |
| 2,665,343 | 1/1954 | Benson | 200/11 K X |
| 2,810,819 | 10/1957 | Gibson | 240/1.3 |
| 2,833,876 | 5/1958 | Westra | 200/51.05 X |
| 2,948,795 | 8/1960 | Brinster et al. | 200/11 J X |
| 3,591,740 | 7/1971 | Kolster | 200/11 J X |
| 3,766,338 | 10/1973 | Handel | 200/11 R |

*Primary Examiner*—James R. Scott
*Attorney, Agent, or Firm*—Arthur L. Plevy

[57] ABSTRACT

There is disclosed a rotary switch assembly comprising a lamp plate adapted to accommodate a plurality of switchable lamps. A power contact plate is positioned above said lamp plate and contains spring loaded contacts which coact with terminals associated with said lamp plate to enable energization of any selected one of said plurality of lamps.

The two plates are positioned and held in alignment by means of a clamping ring into which both plates are located. The clamping ring assures proper detenting of the rotatable lamp accommodating plate to ascertain reliable switching and further assure that any bulb selected will have its optical axis properly aligned.

10 Claims, 15 Drawing Figures

Fig. 5.
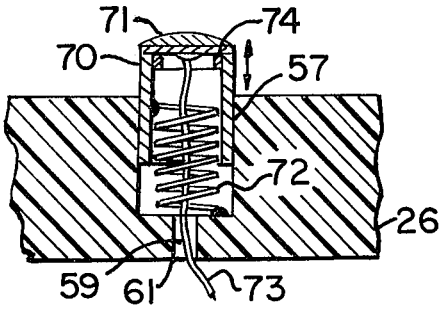
Fig. 6A.
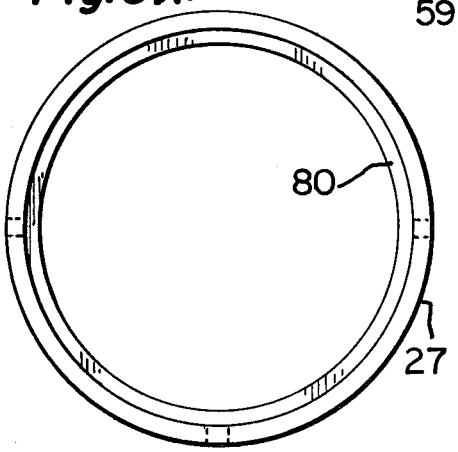
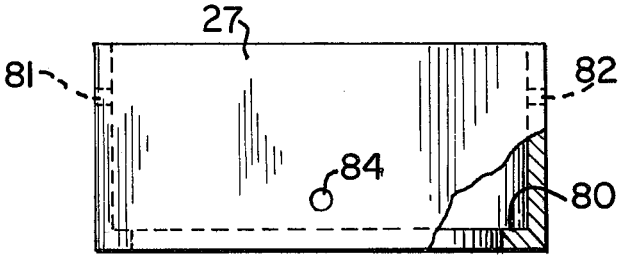
Fig. 6B.
Fig. 7.
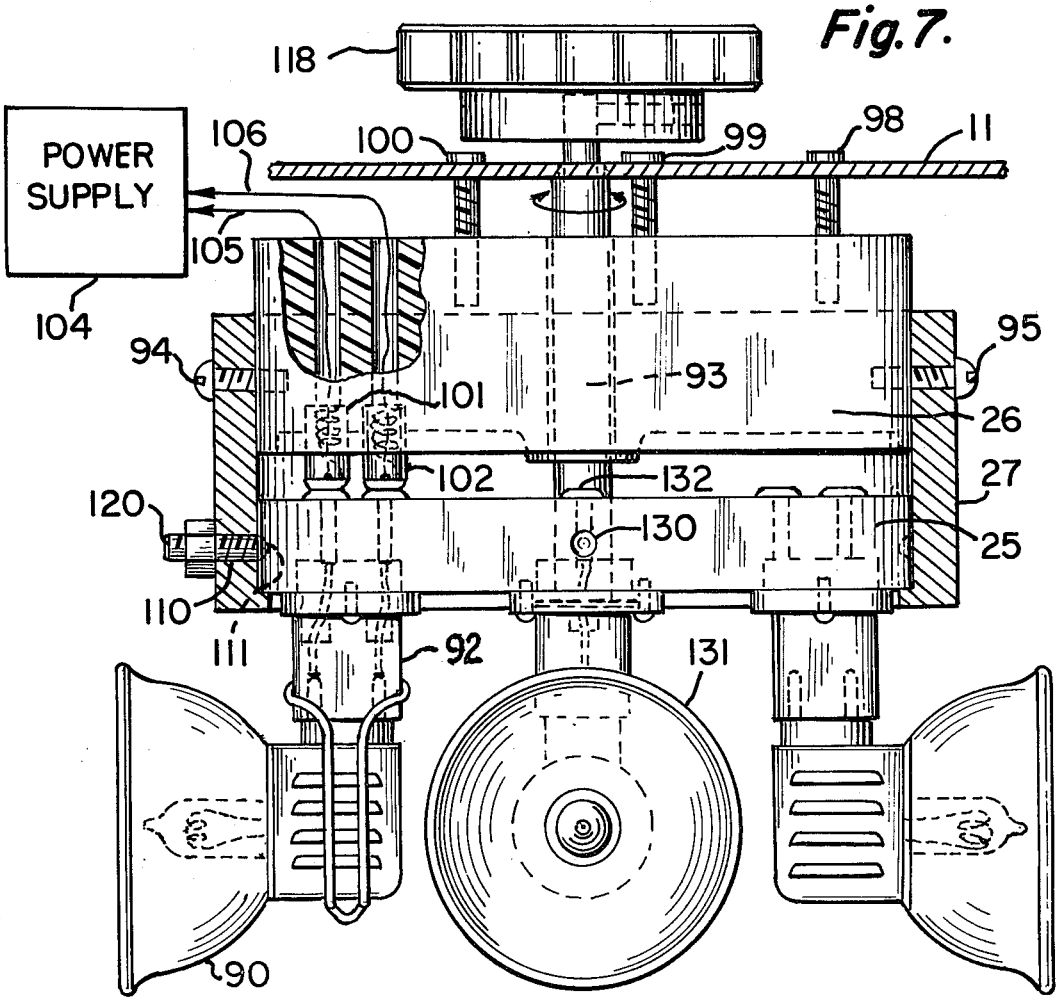

ROTARY SWITCH ASSEMBLY PARTICULARLY ADAPTED FOR USE WITH FIBER OPTIC LIGHT SOURCES

BACKGROUND OF INVENTION

This invention relates to a rotary switch assembly and more particularly to such a switch assembly adapted to selectively energize one of several different lamps from a single source of current and to assure that the lamp when selected and indexed, is properly aligned in regard to an optical system.

Generally, the prior art has been cognizant of the problem of employing a plurality of back-up bulbs or lamps to permit quick replacement of the one being utilized when a failure occurs. Such techniques provide a minimum down-time for the optical system and enable one to continue using the system because of the additional bulb structures.

It is also apparent that when one employs such back-up lamp sources in a relatively accurate optical system, one must assure that a selected bulb will move in to exact registration with either a lens system and so on, to assure and maintain optical system performance.

In conjunction with such approaches, the prior art is replete with a number of references attempting to solve such problems in different environments.

U.S. Pat. No. 1,105,829 entitled Electric Signalling Mechanism patented on Aug. 4, 1914 by O. D. Plummer, et al. shows a railroad or other signalling system which employs a plurality of lamps rotatably mounted in a lantern housing. The lamps as rotated make contact with a carbon block and are under the control of a motor and electromagnets.

The structure is not critical as the use does not dictate an accurate optical system and hence, wide tolerances can be used in implementing the structure.

U.S. Pat. No. 1,426,181 entitled Automobile Lamp issued on Aug. 15, 1922 to F. E. Gregory shows a rotatable disk carrying a plurality of lamps, each one of which is selected by a quarter turn of the disk.

Still other patents as U.S. 1,455,938 entitled Signal Lantern, U.S. Pat. No. 1,495,656 entitled Auto Headlight and U.S. Pat. No. 1,845,399 entitled Locomotive Headlight, show different index structures for bulb replacement in the typical non-critical environments above described.

Still other patents as U.S. Pat. No. 1,915,081 entitled Focusing Lamp with Focusable Reserve Light Bulb and U.S. Pat. No. 1,978,907 entitled Illuminating Unit and U.S. Pat. No. 2,810,819 entitled Light Projecting Apparatus, attempt to show different techniques and structures for accommodating more than one bulb, which bulb can be switched into position in the event a failure occurs in the one being utilized.

With the event of more reliable and highly sophisticated optical systems the need for a back-up provision during bulb burn-out is still apparent. However, due to the nature of such systems, the alignment of the replacement bulb has to be accurately maintained while providing an easily operable, mechanically reliable and economical indexing system.

DESCRIPTION OF PREFERRED EMBODIMENT

A rotary switch assembly for selecting any one of a plurality of lamps used in an operating room light source or the like comprises a first relatively circular plate having a plurality of recesses located on a surface thereof each of said recesses associated with one of said lamps; first and second terminals located in said recesses and electrically connected to associated terminal areas on the other surface of said plate; a second circular plate of a slightly large diameter positioned in alignment with said first plate and having on a surface thereof closest to said terminal area surface of said first plate, a pair of spring loaded power contacts positioned to coact with any one pair of terminal areas associated with said one lamp; means coupled to said first plate for rotating it with respect to said second plate to cause said spring loaded contacts to coact with any selected pair of terminal areas associated with any one of said selected lamps.

BRIEF DESCRIPTION OF FIGURES

FIG. 5 is a partial cross sectional view of a spring loaded power contact according to the invention.

FIG. 6A is a top plan view of a clamping ring useful in this invention.

FIG. 6B is a side view of the ring of FIG. 6A.

FIG. 7 is a partial cross sectional view of a rotary switch assembly according to this invention.

DETAILED DESCRIPTION OF DRAWINGS

Figure 1:
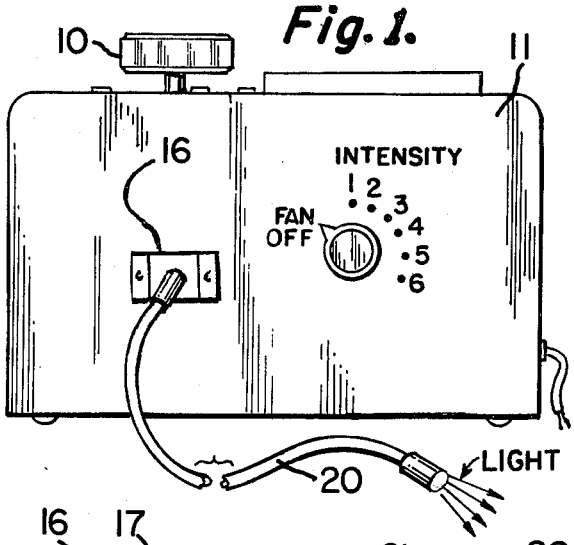
FIG. 1 is a front plan view of an operating room light source useful with this invention.

Before proceeding with a detailed description of the invention, a brief indication of the environment in which the invention is used is believed warranted.

As indicated, rotary switch configurations for use with multiple light sources as bulbs or lamps are known in the prior art, as used with auto headlights, lanterns and so on.

There exists an invaluable piece of equipment known generally as a cold light source and which equipment is extensively used in surgical and operating room procedures.

Basically, the source comprises a fiber optic light bundle which is illuminated by a high intensity, high wattage lamp. The filament of the lamp is directed to an inlet of the filter optic bundle, which bundle may be a few feet long or more. The lamp is housed in a suitable enclosure, where because of its high power, it dissipates a great deal of energy, thus producing a great deal of heat. As such, the lamp and housing have to be cooled by means of a fan or another suitable arrangement.

The surgeon uses the fiber optic bundle as a light source and he can therefore direct the light emanating from the outlet end of the bundle to any desired position. Since the fiber optic bundle is a good conductor of light and since the bundle is long, it does not produce or conduct the heat produced by the lamp in the enclosure. Hence, the term "cold-light" source has been used to define such a light source.

As indicated, the amount of light needed for surgical procedures as neuro-surgery, thoracic surgery, cardiac surgery and so on, is substantial. Due to this fact, lamp sources such as halogen bulbs are used. These bulbs operate at 150 watts or greater at relatively high current and low voltage. The bulbs are relatively compact and have a limited average life capability. A typical average life for such a bulb is about 20 to 25 hours or less.

Due to the intensive heat produced and the attendant heating and cooling of the filaments when the source is turned on and off, even lower life expectancy can occur.

Unfortunately, the bulb can be expected to fail during use, which in the operating room can be in the middle of a difficult and complicated operation.

Thus, the failure of a light source can seriously endanger the operating technique and place the patient in a hazardous position. Moreover, due to the extreme heat generated by the bulb, it becomes difficult to change a bulb until it cools off. Furthermore, there is always the possibility that another bulb is not available and hence this fact can create additional difficulties.

Another extremely important factor is that the bulb cannot be merely replaced as one would replace a bulb in a typical fixture.

As indicated, the alignment of the optical axis of the bulb or lamp filament with the inlet of the fiber optic bundle, is extremely important so that maximum light in a predetermined pattern is available at the outlet of the bundle for the surgeon. Hence, if one merely replaces the bulb, the alignment, due to normal tolerances in the bulb manufacturing process, is not necessarily maintained and hence the light source may still be unuseable.

Referring to FIG. 1, there is shown a front plan view of a typical fiber optic light source assembly and housing. Basically, the unit shown in the figure is representative of the prior art devices with the exception of the knob mechanism 10 which as will be explained, is rotated to provide lamp switching when a presently used lamp burns out.

The unit is housed in a metal or similar rectangular housing 11. It has a light source aperture plate 16 into which a fiber optic cable 20 can be inserted. Located in alignment with the aperture 17 in the plate or mount 16 is the optical axis of the filament of a high intensity lamp. The fiber optic cable 20 is inserted into the aperture 17 and is retained therein by the inlet end coacting with a spring loaded button 18. The button 18 coacts with the ridge 21 about the inlet end of the cable 20. The button 18 is spring loaded and therefore when one inserts the inlet end of the cable 20 into the aperture 16, the button is depressed and springs into the groove 21 when the groove 21 is positioned over the button. Thus the optical axis of the lamp is located at the geometric center of the aperture 17.

The button or spring loaded snap thus securely maintains the cable in the aperture 16 when inserted.

The length of the fiber optic cable 20 can vary but is typically 7.5 feet long and comprises a plurality of fiber optic bundles. As is known, such bundles can transmit light with good efficiency and because of this structure can be bent in multiple positions or flexed without disrupting the light conducted through the cable and emanating from the outlet end of the bundle or cable 20.

While the cable can be used as an illuminating source directly, it can also be inserted into a headlight arrangement to be worn by the surgeon and thus enable him to illuminate the patient or the desired operating area without the use of his hands. Such headlights are known in the surgical field and are not considered to be part of this invention.

Figure 2:
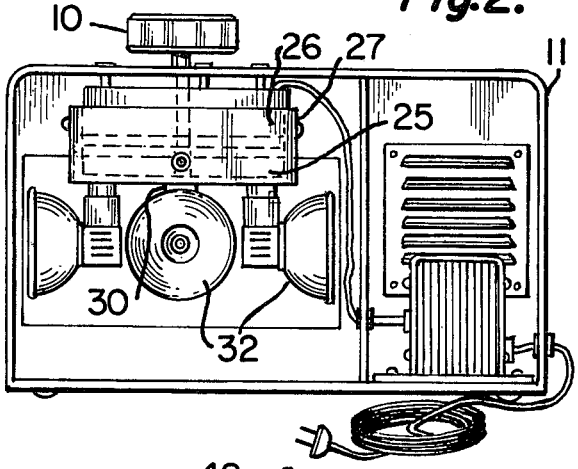
FIG. 2 is a front view of the internal configuration of the source of FIG. 1.

Referring to FIG. 2, there is shown a front view of the unit 11 of FIG. 1 with the front plate removed to show the rotary switch assembly which carries and supports four independent lamps. It is understood that more or less lamps can be accommodated by the arrangement to be described.

The rotary switch basically consists of three main elements, namely, a lamp support plate 25, a power contact support plate 26 and an outer annular ring 27 which is a housing for the two above described plates.

The lamp support plate 25 and the power contact support 26 are fabricated from an insulating material which preferably may be an insulating plastic such as that sold under the trademark DELRAN. Many such plastics are both insulating and self lubricating, in that they are relatively smooth and capable of withstanding high temperature operation. Other plastics as Teflon and so on would suffice as well.

Figure 1A:
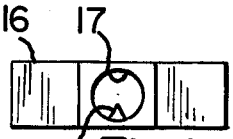
FIG. 1A is a front view of a light emitting aperture plate.
Figure 1B:
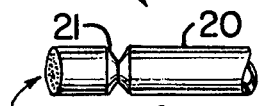
FIG. 1B is a partial side view of an inlet end of a fiber optic cable.

The lamp support plate 25 accommodates four sockets as 30, for example, into which a suitable lamp 32 such as a Halogen unit can be inserted and held. A typical lamp is the Sylvania DNF Halogen lamp, operating at 21 volts with 150 watts. This lamp is a tungsten filament halogen lamp and comes with a built-in reflector. The design of the lamp is such that the optical axis passes through the geometric center of the filament or lamp housing, and has a pre-determined focal length. Because of the focal length, the lamps are positioned in such a way on plate 25, so that as plate 25 is rotated, all focal lengths will remain the same and be at the correct distance in relationship to the fiberoptic bundle 20, FIG. 1B, as positioned in orifice 16. Fiberoptic bundle 20 is now in the correct place. In the manufacture of Halogen bulbs the tolerances of the placement of the filament are very loosely held, and generally run plus or minus 2mm in any direction. The relationship of the filament against the relationship of the reflector has a direct bearing on the relationship of the optical axis of the bulb. The lamp can provide high intensity illumination with a relatively concentrated output light pattern.

As will be explained, each lamp or the plate 25 can be rotated into exact alignment with the aperture 17 of FIG. 1 to therefore optimally illuminate the fiber optic cable 20 (FIG. 1). Thus if a lamp fails, all one has to do is to rotate or turn the knob 10 until the detent mechanism snaps the next bulb into position. When this occurs, power is automatically supplied to the new bulb. Thus with four such bulbs, the effective life of the source has been extended four times and the above described difficulties have been virtually eliminated, allowing the hospital personnel to replace the bulbs at their convenience assuring accurate alignment and registration.

Figure 3A:
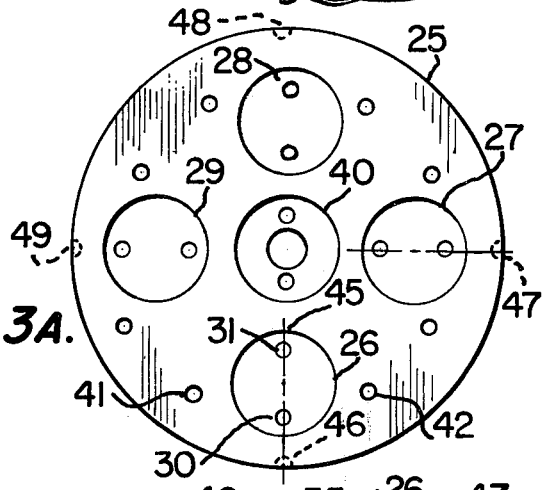
FIG. 3A is a top plan view of a light source accommodating plate according to the invention.
Figure 3B:
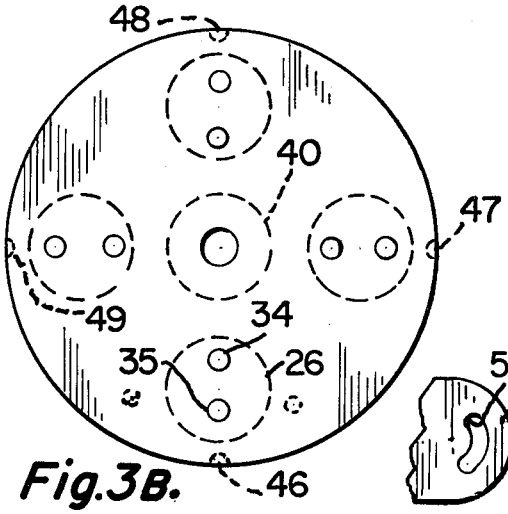
FIG. 3B is a bottom plan view of the plate of FIG. 3A.

Referring to FIG. 3A, there is shown a top view of the lamp support plate 25. The support plate 25 is circular in diameter and is fabricated from an insulating plastic. The plate 25 has four socket accommodating recesses 26,27,28 and 29 located on the surface thereof. Each recess is about .850 inches in diameter and about 0.300 inches deep. Located within each recess are two terminal apertures 30 and 31 of recess 26. These apertures 30 and 31 contain conducting rods or wires which may be fabricated from copper or another good conductor. The conducting terminals in apertures 30 and 31 extend to the opposite surface of the plate 25 (FIG. 3B) where they terminate in smooth conducting terminal areas 34 and 35.

A central recess 40 shown in FIG. 3A is used to secure a shaft member, which as will be shown, is coupled to the knob 10 to facilitate rotation of the lamp support plate 25.

Adjacent each socket recess are two holes 41 and 42 adjacent socket recess 26. These holes 41 and 42 are used to secure a lamp socket to the plate 25.

Shown drawn through the center of the recess 26 is a center line 45. The line 45 denotes the optical axis of the lamp filament. As previously indicated, in order to optimunly illuminate the fiber optic cable (20 of FIG. 1) one has to assure that the bulb's filament is centered with respect to this axis. Shown imbedded in the side of the plate 25 are four detents 46,47,48 and 49.

These detents are factory inserted and comprise indented metal inserts which serve as positioning detents. As seen from FIG. 3, the detents are centered with the recess and terminals which are all centered with respect to the optical axis.

Figure 3D:
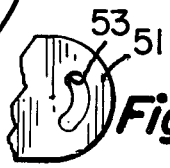
FIG. 3D is a partial top view of a socket tab.
Figure 3C:
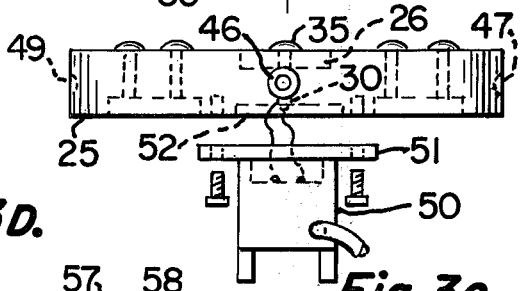
FIG. 3C is a side view of the plate of 3A with a socket.

Referring to FIG. 3C, there is shown a lamp socket 50, which socket is commercially available and designed to accommodate the halogen bulb.

The socket has tabs or ears 51 and 52 on each end. The tabs have apertures to accommodate screws for insertion into the holes as 41 and 42 on the plate 25. FIG. 3D shows a top view of the tab 51, indicating the nature of the aperture 53. As can be seen, the screw fastening the socket 50 to the plate via the aperture 53 can be loosened and the bulb coupled to the aperture can be shifted until the optical axis is aligned properly.

The terminals of the socket 50 are soldered by means of wires to the terminal posts of the plate 25. Hence, each set of terminals 34 and 35 (FIG. 3B) is electrically connected to a bulb socket. Each aperture 26 to 29 is accommodating a socket 50 and each socket is accordingly electrically connected to the associated terminals.

Figure 4B:
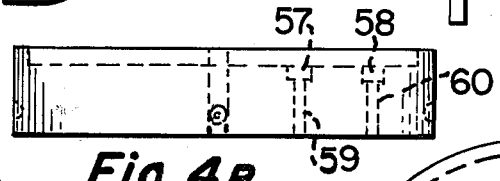
FIG. 4B is a side plan view of the plate of FIG. 4A.
Figure 4A:
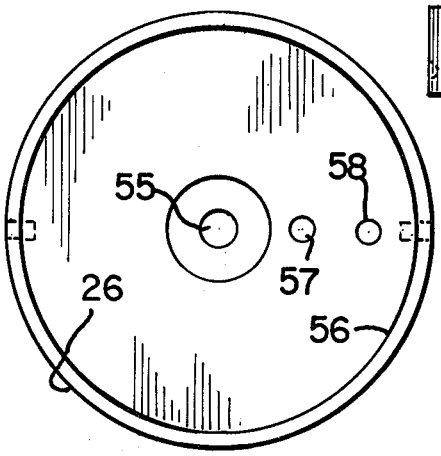
FIG. 4A is a top plan view of a power switch plate according to this invention.

Referring to FIG. 4A, there is shown a top view of the power contact support plate 26. The plate is also circular in shape and has a central aperture 55 for accommodating a common shaft member. The aperture 55 is surrounded by a raised flange. A peripheral flange 56 also extends about the top surface of the plate 26. The flanges support and prevent plate 25 from rocking due to pressure exerted by the housing 70 (FIG. 5).

Figure 4C:
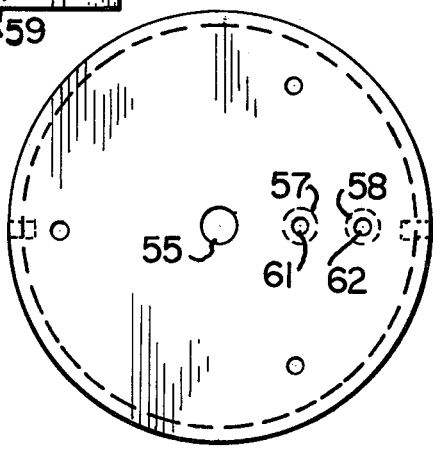
FIG. 4C is a bottom plan view of the plate of FIG. 4A.

Two apertures 57 and 58 are located on the top surface and accommodate spring loaded power contacts. The plate 26 has a series of holes in the side surface to firmly secure the same in the final assembly as well as additional holes in the bottom surface of FIG. 4C. The diameter of plate 26 is slightly larger than that of of plate 25.

The apertures 57 and 58 communicate via the channels 59 and 60 to the other surface of the plate via the apertures 61 and 62 (FIG. 4C) to enable the insertion of power carrying wires therethrough.

As indicated, the apertures 57 and 58 contain spring loaded contacts which contacts are coupled to a source of power via wires which are inserted into the channels 57 and 58 and through the apertures 61 and 62.

FIG. 5 shows a cross section view of a contact as secured in an aperture as 57, for example.

The contacts are cylindrical in shape, the main body 70 being fabricated from a conducting material. Each contact has a copper cover 21 which may be press or force fit into the cylinder 70 or soldered thereto. A phospher bronze spring is inserted into aperture 57 and secures the cylinder within the aperture 57. A wire 73 is directed through the aperture 61 and via channel 59. The wire is capped with a copper terminal 74 which is pushed by the spring to contact the copper cover 71. The spring may be stainless steel or some other good spring material.

It is important to note that no current is conducted by the spring 72 even though such a spring could accommodate current. This additional feature avoids the loss of spring temper due to the large currents used by the lamp and hence the spring 72 is not cold worked and does not break as easily.

FIGS. 6A and 6B show the metal clamping ring 27 of FIG. 1. The ring 27 is fabricated from metal or aluminum or a hard plastic and is basically an annular ring with a protruding flange 80 about the periphery of one end. The ring has apertures 81 and 82 in the side for securing the same to corresponding apertures in the contact plate 26 of FIG. 4. The ring 27 also has a detent aperture 84, into which is inserted an adjustable detent screw which contacts with the metal detents 46 (FIG. 3) on the lamp socket accommodating plate 25 of FIG. 3.

FIG. 7 shows a cross sectional view of an assembled switch.

The operation is as follows: The clamping ring contains the lamp accommodating plate 25 with the socket apertures and bulbs positioned as shown in both the FIGS. 7 and 2. The bulbs 90 are securely held in the sockets by a metal clamp holder 91 integral with the socket 92.

A main shaft is inserted through the shaft accommodating apertures of plates 25 and 26 and the bottom of the shaft terminates in a circular flange which is secured to the bottom or lamp accommodating plate 25 by means of the apertures shown in FIG. 3A and located within recess 40. The power contact plate 26 is rigidly secured to the clamping ring 27 by means of screws 94 and 95 so tht it can't rotate with respect to the clamping ring 27.

The fixed power contact plate 26 may also be secured by means of screws 98, 99 and 100 to the lamp housing 11 of FIG. 1.

The spring loaded contacts 101 and 102 are shown in contact with the terminal areas associated with the lamp 90 and socket 91.

The spring contacts are coupled to a source of power 104 via the wires 105 and 106. Since the contacts are spring loaded they are being pushed upward by the raised terminal areas of the socket plate 25 and hence good and reliable contact is made. An indexing screw 120 is positioned with the aperture 110 in the metal ring 27 and is coacting with the detent 111 in the side of the plate 25. Since the detent 111 is aligned with the optic axis of the bulb 90 and the lamp has been positioned via the adjustment above described, proper illumination of the fiber optic bundle is ascertained.

Assume the bulb 90 burns out during an operation. All one does is to grasp the handle or knob 118 which is rigidly secured to the shaft 93 and rotate the same in either direction. The spring contacts 101 and 102 will move off the terminals associated with lamp 90 and the indexing screw 120 will move out of the detent 111. Upon rotation, the screw 120 will coact or snap into another detent 111 associated wit lamp 131. The power contacts will automatically be in contact with the terminals as 132 associated with this lamp 130 and the lamp, if good, will light since power is supplied via the supply 104.

Since all the lamps are properly aligned immediate operation is continued without interruption.

It is noted that the force extended by the indexing screw 120 is always perpendicular to the central shaft 93 and hence this force cannot disturb the optic axis alignment. As indicated, the plate 25 is slightly less of a diameter than plate 26. Since plate 25 carries the high intensity lamps and since it is rotatable, this is desireable. A main fact being that the intensive heat produced by the lamps would tend to expand the plate 25 and hence a smaller diameter would be required.

The clamping ring 27 prevents play between the plates 26 and 25 and assures that reliable indexing and contact will always be maintained.

In summation, there is shown and described a simple, reliable and accurate rotary switch, which switch can accommodate a plurality of bulbs each one of which can be connected in circuit by the turning of a shaft.

Due to the fact that the plates 25 and 26 are insulating, there is no shock hazard as all electrical power sources or points are isolated from the user.

The surface of the terminals and the spring loaded contacts are shaped to prevent undue arcing upon bulb switching which arcing occurs mainly at the edge. Therefore as shown illustratively, the center contact areas are raised to prevent gapping due to arcs.

While the apparatus has been shown in the environment of a cold source using a fiber optic cable, it could be used in any other environment where alignment of the light sources is important as well as the other advantages attendant in the invention.

A major factor being that due to the optical axis and the focal length of these bulbs, alignment of the same with the fiber optic cable is extremely important. Therefore, the above noted switch with its corresponding detents, plates and shaft assembly assure that all parts are adequately maintained with the focal length and optical axis of the four bulbs.

I claim:

1. A rotary switch particularly adapted for use with an operating room light source, comprising:

a. a first rotatable plate fabricated from an insulating material and having a plurality of lamp accommodating socket recesses located on a first surface thereof, b. at least on wire accommodating aperture located in each of said recesses coacting with an associated terminal area for each of said apertures, said terminal area positioned on the opposite surface of said first plate, c. a second plate positioned above said first plate and stationary with respect thereto, said second plate having an aperture located on a surface thereof closest to said first plate, d. a moveable power contact positioned in said aperture and adapted to contact any one of said terminal areas on said first plate, when said first plate is rotated with respect to said second plate, e. an annular housing for surrounding a portion of said first and second plates to secure them in a predetermined position one above the other whereby when said first plate is rotated said power contact can coact with any one of said terminal areas, and f. means coupled to said first plate for rotating the same.

2. The rotary switch according to claim 1 wherein said first plate is fabricated from an insulating plastic.

3. The rotary switch assembly according to claim 1 wherein said lamp accommodating socket recesses are capable of accommodating a tungsten halogen lamp.

4. The rotary switch assembly according to claim 3 wherein said plurality of lamp accommodating socket recesses comprise four areas each adapted to support a lamp.

5. The rotary switch assembly according to claim 1 wherein said moveable power contact comprises:

a. a longitudinal tubular member having an open top and bottom end, b. a conducting cover cap secured to said top end, and c. a spring located in said cylinder and inserted in said aperture to permit movement of said contact in directions relatively perpendicular to the surface of said second plate.

6. The rotary switch assembly according to claim 1 wherein said means coupled to said first plate for rotating the same includes a central shaft secured to said first plate and inserted through a central aperture in said second plate for rotating said first plate with respect to said second plate.

7. The rotary switch assembly according to claim 1 wherein said first plate further includes a plurality of detent means each one associated and aligned with a respective one of said lamp accommodating socket recesses, said detents means located on the side surface of said first plate, and aligned with the geometric center of said associated recess, b. a detent coacting element secured to said annular housing and adapted to coact with any one of said detents on said side surface of said first plate to enable selection of any one of said socket recesses associated with said detent.

8. A lamp detector switch assembly particularly adapted for use with an operating room light source of the type utilizing a fiber optic cable having a light inlet end, comprising:

first and second concentric plates each having a colinear central aperture, said first plate having a series of socket accommodating areas on a bottom surface thereof, each of said areas having at least one terminal area directed to the opposite surface of said first plate; said second plate positioned above said first plate and having on a surface closest to said first plate, a power contact assembly positioned to coact with any one of said terminal areas on said closest surface of said first plate, b. a clamping housing surrounding said first and second plates; including means for rigidly securing said second plate to said housing while permitting rotation of said first plate, and c. a central shaft directed through said colinear apertures and extending from a top surface of said second plate, said shaft being rigidly secured to said first plate to enable rotation of said first plate with respect to both said second plate and said housing, whereby said power contact can contact any one of said terminal areas when said first plate is rotated with respect to said second plate.

9. A rotary switch assembly for selecting any one of a plurality of lamps, comprising:

a. a first relatively circular plate having a plurality of recesses located on a surface thereof, each of said recesses associated with one of said lamps, b. first and second terminals located in each of said recesses and electrically connected to an associated pair of terminal areas on the other surface of said plate, c. a second circular plate of a slightly larger diameter positioned above and in alignment with said first plate and having on a surface thereof closest to said terminal area surface of said first plate, a pair of spring loaded power contacts positioned to coact with any one pair of terminal areas associated with said one lamp, d. means coupled to said first plate for rotating it with respect to said second plate to cause said spring loaded contacts to coact with any selected pair of terminal areas associated with any one of said selected lamps.

10. The rotary switch assembly according to claim 9 further including:

a. an annular housing having a flange about one end, said housing positioned about portions of said first and second plates to position them one above the other and detent means coupled to a surface of said housing and operative to coact with said first plate to assure selection of any one of said lamps.

* * * * *